US008550043B2

(12) United States Patent
Naganuma et al.

(10) Patent No.: US 8,550,043 B2
(45) Date of Patent: Oct. 8, 2013

(54) TWO-STROKE ENGINE AND MOTORIZED IMPLEMENT EQUIPPED WITH THE TWO-STROKE ENGINE

(75) Inventors: Kenji Naganuma, Hitachinaka (JP); Kentaro Kanaya, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 523 days.

(21) Appl. No.: 12/725,348

(22) Filed: Mar. 16, 2010

(65) Prior Publication Data

US 2010/0236082 A1 Sep. 23, 2010

(30) Foreign Application Priority Data

Mar. 17, 2009 (JP) ..... 2009-064756

(51) Int. Cl.
*F02B 33/04* (2006.01)

(52) U.S. Cl.
USPC ..... 123/73 PP; 30/381

(58) Field of Classification Search
USPC ..... 123/73 PP; 30/381
See application file for complete search history.

(56) References Cited

U.S. PATENT DOCUMENTS 3,752,129 A 8/1973 Kobayashi et al.
7,243,622 B2 * 7/2007 Tsutsui et al. ..... 123/73 PP

FOREIGN PATENT DOCUMENTS

| | | | |
|---|---|---|---|
| JP | 48-67616 | A | 9/1973 |
| JP | 60-006017 | A | 1/1985 |
| JP | 11-315722 | A | 11/1999 |
| JP | 2001-214745 | A | 8/2001 |
| JP | 2007-077942 | A | 3/2007 |
| JP | 2008-111339 | A | 5/2008 |
| JP | 2008-138602 | A | 6/2008 |
| JP | 2009-002311 | A | 1/2009 |
| JP | 2009-019524 | A | 1/2009 |

OTHER PUBLICATIONS

Japan Patent Office action for patent application JP2009-064756 (Sep. 4, 2012).

* cited by examiner

*Primary Examiner* — Noah Kamen
(74) *Attorney, Agent, or Firm* — Kilpatrick Townsend & Stockton LLP

(57) ABSTRACT

An exhaust port and an intake port are formed across a crankshaft with a flywheel provided at one end when viewed in a direction of an axis of a cylinder at a two-stroke engine. A pair of scavenging ports is then formed between the exhaust port and the intake port. Scavenging path covers are fitted to a cylinder block of the two-stroke engine and constitute part of scavenging paths that connect the scavenging ports and a crank chamber. The scavenging path cover close to the flywheel is positioned between an axis of the crankshaft and an exhaust path connected to the exhaust port or an intake path connected to the intake port.

15 Claims, 6 Drawing Sheets

TWO-STROKE ENGINE AND MOTORIZED IMPLEMENT EQUIPPED WITH THE TWO-STROKE ENGINE

CROSS-REFERENCE TO RELATED APPLICATION

This application claims the benefit of Japanese Patent Application No. 2009-064756 filed Mar. 17, 2009, the entire disclosure of which is incorporated herein by reference.

FIELD

The present invention relates to two-stroke engines, and more particularly to, a two-stroke engine equipped with a motorized implement suitable for use with a handheld motorized implement such as a lawnmower, chainsaw, or blower.

BACKGROUND

It is necessary for an engine of a motorized implement to be both lightweight and compact in order for the motorized implement to be carried by an operator during operation. Simple two-stroke engines that are small and lightweight in structure, and in particular, two-stroke reverse flow type engines such as the engine disclosed in Unexamined Japanese Patent Application KOKAI Publication No. H11-315722 are therefore commonly used as engines for motorized implements.

However, in recent years, it has become necessary for the engines to have low gas emission characteristics. Reverse flow type two-stroke engines that have low emission characteristics are a result of appropriate control of scavenging flow from scavenging ports into a combustion chamber. A way of internally shaping a scavenging path is therefore desireable in order to control the scavenging flow. When the scavenging path overhangs outside of the cylinder, it invites larger engine dimensions. Manufacturing costs also increase due to the complexity of the shape of the scavenging paths when formed within a cast cylinder block.

SUMMARY

In order to resolve the aforementioned problems, it is an object of the present application to disclose a two-stroke engine capable of being implemented in a small, complex scavenging path shape.

In order to resolve the problems described above, a two-stroke engine of a first aspect of the present application comprises a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, and one pair of scavenging path covers attached to the cylinder block for providing one pair of scavenging paths connecting the scavenging ports and a crank chamber. The scavenging path cover close to the flywheel is positioned between an axis of the crankshaft and an exhaust path connected to the exhaust port or an intake path connected to the intake port when viewed in an axial direction of the cylinder.

The scavenging ports can preferably be arranged substantially symmetrically with respect to a plane passing through the center of the exhaust port and an axis of the cylinder and face towards a wall surface on the opposite side to the exhaust ports of the cylinder when viewed in an axial direction of the cylinder.

When viewed in an axial direction of the cylinder, the intake port is located so as to be displaced from a plane perpendicular to the clankshaft axis in a direction towards the flywheel. The exhaust port is then arranged so as to be displaced from a plane perpendicular to the clankshaft axis in a direction away from the flywheel. The scavenging path cover that is close to the flywheel is then preferably positioned between the crankshaft axis and the exhaust path connected to the exhaust port.

When viewed in an axial direction of the cylinder, the exhaust port is located so as to be displaced from a plane perpendicular to the clankshaft axis in a direction towards the flywheel. The intake port is then arranged so as to be displaced from a plane perpendicular to the clankshaft axis in a direction away from the flywheel. The scavenging path cover that is close to the flywheel is then preferably positioned between the crankshaft axis and the intake path connected to the intake port.

It is also preferable for the exhaust path and the intake path to extend perpendicularly to the axis of the crankshaft when viewed in an axial direction of the cylinder.

It is also preferable for the scavenging path covers to be fitted to the cylinder block using a plurality of fitting members and for the fitting member positioned close to the flywheel when viewed in an axial direction of the cylinder to be positioned on the outside of the outer periphery of the flywheel when viewed in the axial direction of the crankshaft.

The scavenging path cover close to the flywheel is preferably located further towards the direction of rotation of the flywheel within a region closer to the cylinder side than the axis of the crankshaft when viewed in an axial direction of the crankshaft.

A two-stroke engine of a second aspect of the present invention is a two-stroke engine comprising a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, and one pair of scavenging path covers fitted to the cylinder block using fastening members for providing one pair of scavenging paths connecting the scavenging ports and a crank chamber. When viewed in the axial direction of the cylinder, a fitting surface for the cylinder block and the scavenging path cover is provided inclined with respect to the axis of the crankshaft, and a distance between a plane passing through the axis of the cylinder perpendicular to the axis of the crankshaft and a plane facing the cylinder block of the flywheel is shorter than a maximum distance between a plane passing through the axis of the cylinder parallel with the fitting surface and the scavenging path cover or a fastening member close to the flywheel.

A two-stroke engine of a third aspect of the present invention is a two-stroke engine comprising a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, and one pair of scavenging path covers fitted to the cylinder block using fastening members for providing one pair of scavenging paths connecting the scavenging ports and a crank chamber. A portion of the scavenging path cover or the fastening member close to the flywheel, when viewed in an axial direction of the cylinder, that is furthest away from a plane passing through the cylinder axis perpendicular to the axis of the crankshaft is positioned to a side further from the cylinder block than a surface facing the cylinder block of the flywheel, and when viewed in an axial direction of the crankshaft, the portion of the scavenging path cover or the fastening member close to the flywheel, that is furthest away from the plane passing through the cylinder axis perpendicular to the crankshaft is positioned outside of the outer periphery of the flywheel.

A motorized implement of a further aspect of the present invention is equipped with the two-stroke engine.

It is also preferable for the motorized implement to be a chainsaw, and for the two-stroke engine to be located in such a manner that the crankshaft is at a right angle with respect to the direction of projection of a guide bar.

According to the present invention, when viewed in the axial direction of the cylinder, the scavenging path cover close to the flywheel is positioned between the axis of the crankshaft and the exhaust path connected to the exhaust port or the intake path connected to the intake port. It is therefore possible to make the distance between the cylinder and the flywheel short, to reduce the dimensions in the axial direction of the crankshaft of the engine, and to make the engine is smaller.

BRIEF DESCRIPTION OF THE DRAWINGS

A more complete understanding of this application can be obtained when the following detailed description is considered in conjunction with the following drawings, in which.

DETAILED DESCRIPTION

Figure 1:
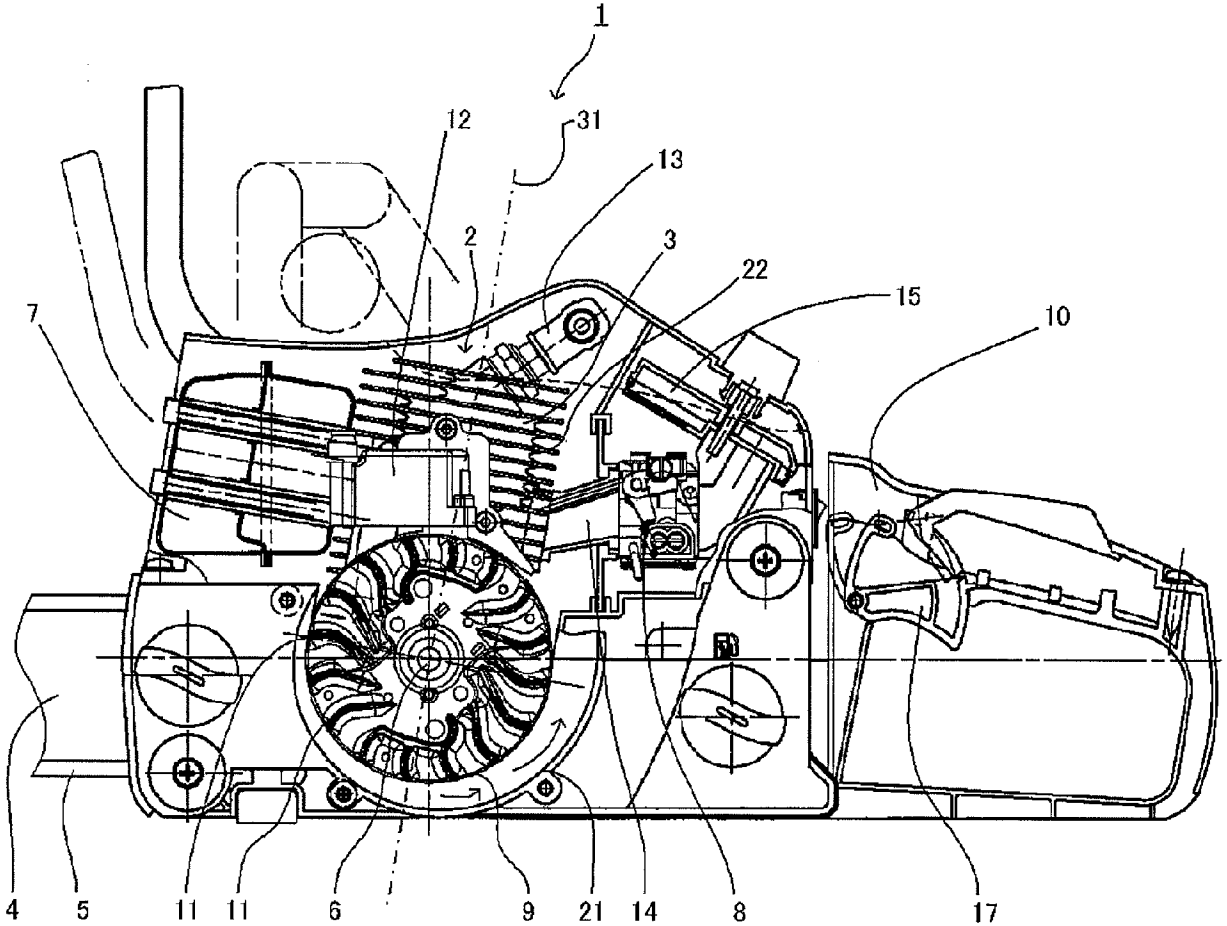
FIG. 1 is a partial cut-away side view of a chainsaw mounted with a two-stroke engine of a first embodiment of the present invention.

The following is an explanation of a first embodiment of the present application in line with the appended drawings. As illustrated in FIG. 1, a chainsaw 1 preferably mounted with a Schnurle-type reverse flow-type two-stroke engine 2 ("engine") preferably has the engine 2 for driving a saw chain 5 guided by a plate-shaped guide bar 4. The engine 2 is preferably located between the guide bar 4 and a rear handle 10. A cylinder axis 31 (A circular center of a circular end of cylinder 23 within a cylinder block 3 of the engine 2) preferably extends at a slightly inclined angle in a clockwise direction from the vertical axis with respect to the projection of the guide bar 4 and the saw chain 5 in FIG. 1. An axial direction of a crankshaft 6 of the engine 2 is preferably perpendicular with respect to the projection of the guide bar 4 and the saw chain 5. A muffler 7 is then preferably arranged on the side of the saw chain 5 and a carburetor 8 is preferably arranged on the side of the rear handle 10 across the cylinder block 3. The carburetor 8 is preferably connected to the engine 2 via an intake pipe 14. The muffler 7 is preferably connected to the engine 2 via an exhaust pipe (not shown). The carburetor 8 is preferably connected to an air cleaner 15, a fuel tank (not shown) that supplies fuel, and a throttle lever 17 for adjusting the extent of the throttle's opening which in turn controls the speed of the engine 2 provided at the rear handle 10.

A flywheel 9 is preferably fitted to the engine 2 via the crankshaft 6. A surface of the flywheel 9 facing the engine 2 is preferably flat. A plurality of fins 11 are preferably formed at an end surface of the flywheel 9 on the opposite side of the engine 2. When the flywheel 9 rotates, the fins 11 preferably function as fins for circulating cooling air. The engine 2 preferably encloses both the flywheel 9 and an engine case 21. When the flywheel 9 is rotated in an a counterclockwise direction as illustrated in FIG. 1, wind generated by the fins 11 preferably flows in the direction of the cylinder block 3 along the engine case 21, as illustrated by the arrows. Wind flowing in the direction of the cylinder block 3 then passes through cooling fins formed on the cylinder block 3 thereby cooling the engine 2. A magnet (not shown) is preferably provided at the flywheel 9 and an ignition coil 12 is preferably provided at a side of the cylinder block 3 above the flywheel 9. An ignition plug 13 is preferably fitted to a top section of the cylinder block 3. High voltage generated from the rotation of flywheel 9, preferably causes ignition coil 12 and the magnet to attract and repel each other. The high voltage is preferably supplied from the ignition coil 12 to the ignition plug 13. The ignition plug 13 then preferably ignites the mixture.

Figure 2:
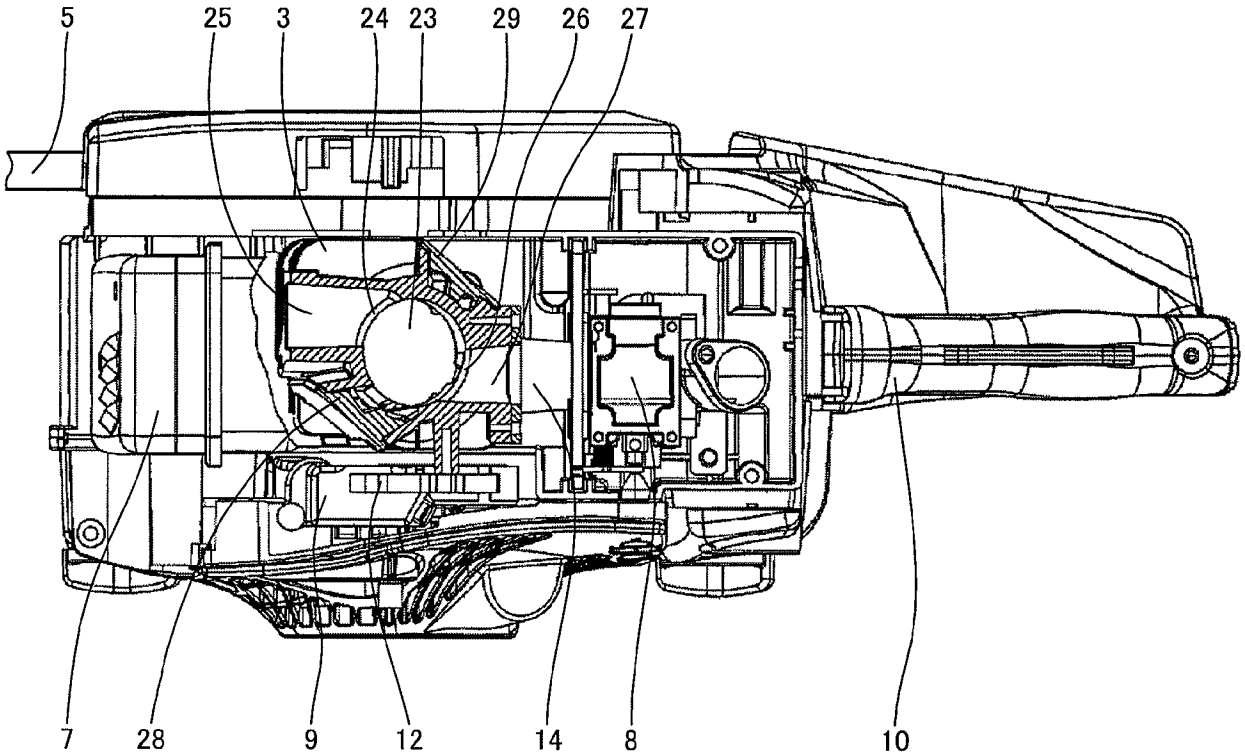
FIG. 2 is a plan view taking a cross-section where height changes so that a cross-section of an exhaust port and of an exhaust path in an axial direction of the cylinder and a cross-section of an intake port and an intake path appear for the cylinder block and its surroundings for the chainsaw of FIG. 1.

As illustrated in FIG. 2, an exhaust path 25 preferably connected to an exhaust port 24 of the cylinder block 3 and an intake path 27 connected to an intake port 26 are preferably parallel to the projection of the guide bar 4, the saw chain 5 and the rear handle 10. The exhaust path 25 is preferably connected to the muffler 7 via an exhaust pipe (not shown). The intake path 27 is preferably connected to the carburetor 8 via the intake pipe 14. Scavenging path covers 28 and 29 constituting part of two pairs of scavenging paths are preferably fitted between the intake path 27 and the exhaust path 25 with respect to the circumference of the cylinder 23 of the cylinder block 3.

Figure 3:
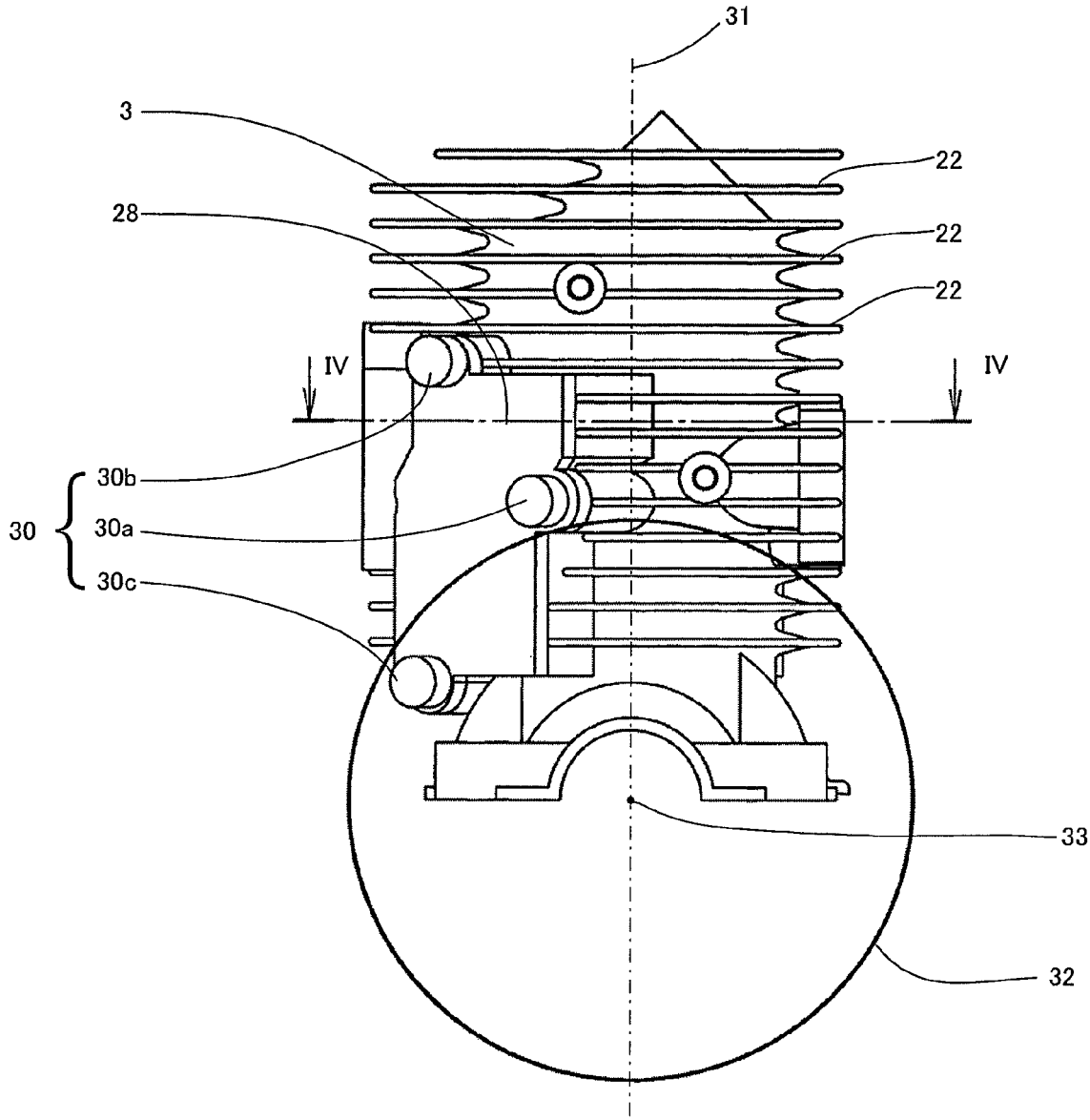
FIG. 3 is a side view illustrating a flywheel side of a cylinder block portion of the engine for the chainsaw of FIG. 1.

As illustrated in FIG. 3, the scavenging path cover 28, which is in substantial proximity to the flywheel 9, is preferably fixed to the cylinder block 3 preferably using bolts 30 (fastening members). The scavenging path cover 29 (not shown), which is substantially further away from the flywheel 9, is also preferably fixed using bolts 30 as with the scavenging path cover 28. Referring to FIG. 3, a bolt 30*a* which may be positioned substantially closer (closer to the cylinder axis 31) to the flywheel 9 than bolts 30*b* and 30*c*, which in turn may make the scavenging path cover 28 closest to the flywheel 9, is preferably positioned within substantial proximity to the outer edge 32 of the flywheel 9, when viewing bolt 30*a* in the direction of the crankshaft axis 33, as illustrated in FIG. 3.

Figure 4:
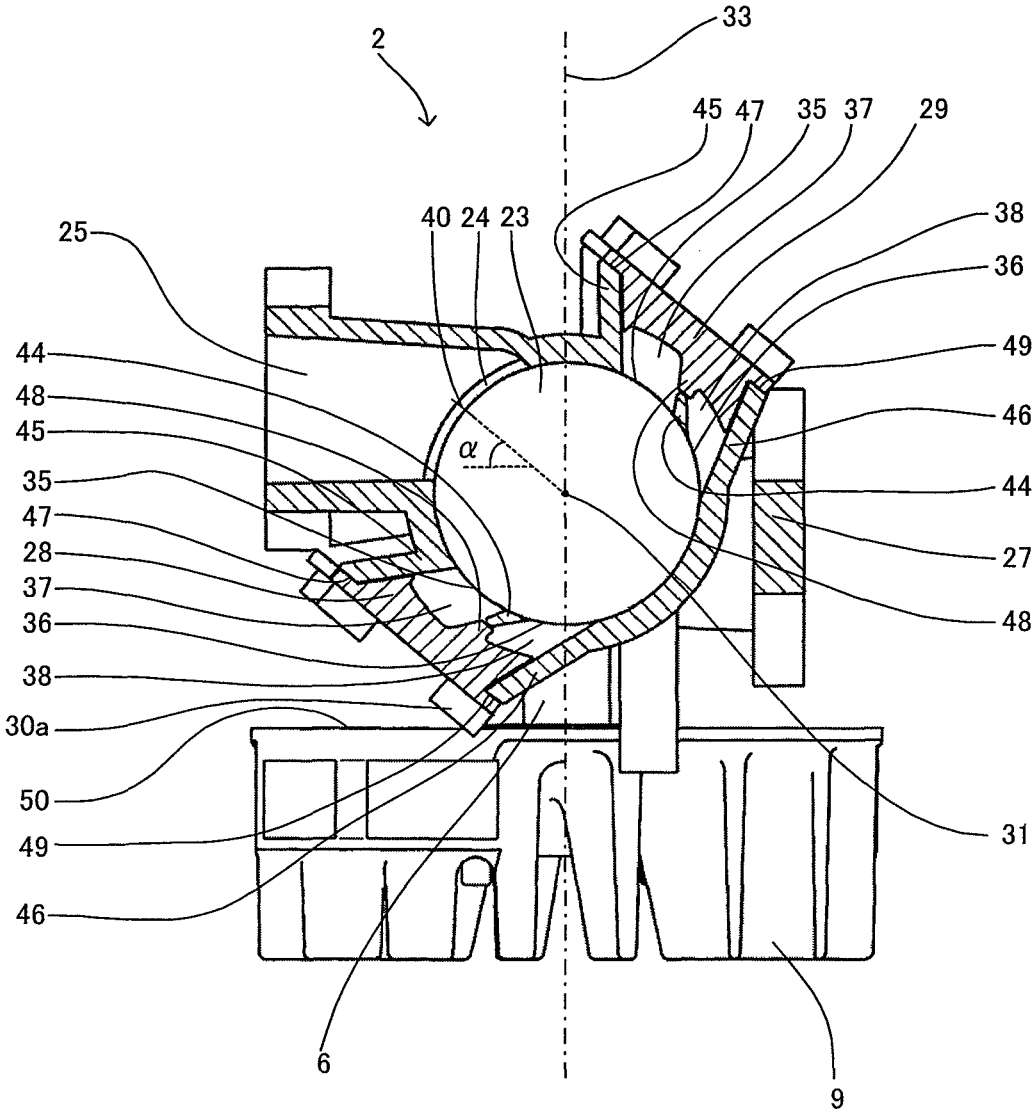
FIG. 4 illustrates a cross-sectional view along IV-IV of FIG. 3.

As illustrated in FIG. 4, the exhaust port 24, which can be opened and closed by a piston (not shown), the intake port 26 (not shown), and a pair of first and second scavenging ports 35 and 36 across the cylinder 23 are preferably formed on an inner wall (side wall) within the cylinder 23. A center 40, preferably symetrically aligned with a portion of the circumference of the exhaust port 24, is preferably positioned further away from the flywheel 9 (in the upper part of FIG. 4) than the cylinder axis 31 relative to the direction of the axis 33 of the crankshaft 6 as viewed in the direction of the cylinder axis 31. The center 40, which is preferably symmetrically aligned with the center of the circumference of the exhaust port 24, is preferably positioned deviating from a horizontal axis of cylinder 23 so that a line linking the center 40 and the cylinder axis 31, that is rotated in a clockwise direction from a horizontal axis perpendicular to the crankshaft axis 33, forms an angle α of, for example, 40 degrees. The exhaust path 25 then preferably extends parallel to a horizontal plane perpendicular to the crankshaft axis 33.

When viewing in the direction of the cylinder axis 31, the intake port 26 is preferably formed facing the exhaust port 24 in such a manner that the center of intake port 26 is symmetrically aligned with a portion of the circumference of cylinder 23. Furthermore, the symmetrically aligned center of the intake port 26 and the center 40, which is symmetrically aligned with the center of the circumference of cylinder 23, preferably across the cylinder axis 31. The positions of the exhaust port 24 and the intake port 26 are preferably aligned at different distances from the cylinder axis 31. The intake path 27 preferably extends from the intake port 26 in a direction opposite from the exhaust path 25. The intake path 27 is also parallel to a horizontal plane that is perpendicular to the crankshaft axis 33.

Viewing in the direction of the cylinder axis 31, the position of the center 40 of exhaust port 24, which is in symmetry with the center of the circumference of cylinder 23, and the position of the center of intake port 26, which is also in symmetry with the center of cylinder 23 of the intake port 26, are different with respect to the direction of the crankshaft axis 33. Regarding the direction of the crankshaft axis 33, the center 40 of the exhaust port 24 is preferably further away from the flywheel 9 than the cylinder axis 31. Regarding the direction of the crankshaft axis 33, the center of the intake port 26 is preferably closer to the flywheel 9 than the cylinder axis 31. The exhaust path 25 and the intake path 27 therefore preferably parallel to each other and face directions opposite from each other as viewed in the direction of the cylinder axis 31.

The first and second scavenging ports 35 and 36 preferably pass through a crank chamber within a crank case (not shown) via first and second scavenging paths 37 and 38, which extend in parallel to the direction of the cylinder axis 31. The first and second scavenging paths 37 and 38 are preferably grooved passages having a bulkhead 44, an exhaust side wall 45, and an intake side wall 46, open in a direction towards the outside, and formed in the cylinder block 3 and the substantially planar scavenging path covers 28 and 29, which preferably have bulkheads 48 embedded into the open paths. An edge 47 of the exhaust side wall 45 and an edge 49 of the intake side wall 46 are preferably on substantially the same plane and are substantially in parallel with the planar portion of the scavenging path covers 28 and 29 viewed in the direction of the cylinder axis 31. The edge 47 of the exhaust side wall 45 and the edge 49 of the intake side wall 46 are adapted to act as fitting surfaces for the scavenging path covers 28 and 29 and these fitting surfaces are inclined with respect to the vertical axis 33 of the crankshaft 6.

Two first scavenging ports 35 are preferably arranged substantially equidistantly from a plane passing through the center 40. The first scavenging ports 35 are preferably arranged on either side of the exhaust port 24 and the cylinder axis 31 and in substantial proximity of the circumference of the circular end of cylinder 23 when viewed in the direction of the cylinder axis 31. Similarly, two second scavenging ports 36 are preferably arranged substantially equidistantly from a plane passing through the center 40. The two second scavenging ports 36 are preferably arranged on either side of the exhaust port 24 and the cylinder axis 31 and in substantial proximity of the circumference of the cylinder 23 when viewed in the direction of the cylinder axis 31. The respective opening directions of the first and second scavenging ports 35 and 36 preferably face outwardly from substantially the opposite sides of the exhaust port 24 across the cylinder axis 31. As shown in FIG. 4, the grooved paths of the cylinder block 3 are preferably formed so that the scavenging path cover 28 on the side of the flywheel 9 is positioned between the exhaust path 25 and the crankshaft axis 33 so that the preferred arrangement of cylinder block 3 positions the scavenging path cover 29 located on the side opposite the flywheel 9 between the intake path 27 and the crankshaft axis 33. The bolts 30 fixing the scavenging path cover 28 on the side of the flywheel 9 are all preferably positioned so that there is no interference with the flywheel 9. This is to say that, in FIG. 4, the bolt **30*a* positioned closest to the flywheel 9 projects further away from the cylinder block 3 than a horizontal plane 50 facing the cylinder block 3 of the flywheel 9. However, the bolt 30*a* is preferably positioned within substantial proximity to the outer peripheral edge 32 of the flywheel 9 as shown in FIG. 3. In other words, the bolt 30*a* does not interfere with the flywheel 9. When viewed in the direction of the cylinder axis 31, a distance between a horizontal plane, perpendicular to the crankshaft axis 33 and passing through the cylinder axis 31, and the horizontal plane 50 facing the cylinder block 3 of the flywheel 9 is shorter than a maximum distance between a plane parallel to a flat portion of the scavenging path cover 28 or a fitting surface of the scavenging path cover 28, the plane passing through the cylinder axis 31, and a flat portion of the scavenging path cover 28 or the head of the bolt 30*a***.

With the engine 2 constructed in the above manner, the mixture flowing in from the first and second scavenging ports 35 and 36 within the cylinder 23 spurts in the opposite direction of the exhaust port 24, turns around within the cylinder 23, and combustion gas flows out from the exhaust port 24. In order to improve the low emission characteristic of the engine 2, it is important for prevent the mixture flowing in from the first and second scavenging ports 35 and 36 from flowing out from the exhaust port 24 but rather for the combustion gas to be more substantially exhausted. It is therefore necessary for the inside of the first and second scavenging ports 35 and 36, and the first and second scavenging paths 37 and 38 to be structured appropriately.

In the engine 2 above, the first and second scavenging paths 37 and 38 are preferably structured from the groove shaped path formed in the cylinder block 3 and the scavenging path covers 28 and 29. The groove shaped path formed in the cylinder block 3 is open in a direction towards the outside of the cylinder block 3. It is therefore possible to easily implement shapes for the first and second scavenging ports 35 and 36 and the internal shapes for the first and second scavenging paths 37 and 38 that are appropriate for the flow of the mixture and the exhaust gases within the cylinder 23 at a low cost using casting of the cylinder block 3 and mechanical processing performed after casting.

Furthermore, viewing in the direction of the cylinder axis 31, the exhaust port 24 is located in such a manner that the center 40, which is in circumferential symmetry with a portion of the circumference of cylinder 23, is positioned on a portion of cylinder 23 that is further away from the flywheel 9 than the cylinder axis 31 with regards to the direction of the crankshaft axis 33. The intake port 26 and the first and second scavenging ports 35 and 36 are positioned at distances corresponding to positions of the exhaust port 24 deviating in the circumferential direction of the cylinder 23 when viewed in the direction of the cylinder axis 31. As a result of locating each port in a displaced manner, the exhaust path 25 and the intake path 27 extend in parallel with each other in a direction perpendicular to the crankshaft axis 33 when viewed in the direction of the cylinder axis 31. The scavenging path cover 28 on the side of the flywheel 9 is preferably located at space occurring as a result of the exhaust path 25 being displaced in a direction away from the flywheel 9 between the exhaust path 25 and the crankshaft axis 33. The scavenging path cover 29 on the side furthest away from the flywheel 9 is located at space occurring as a result of the intake path 27 being displaced in a direction closer to the flywheel 9 between the intake path 27 and the crankshaft axis 33. The bolts numeral 30 that fix the scavenging path cover 28 are all located at positions that do not interfere with the flywheel 9. A distance between a horizontal plane passing through the cylinder axis 31 perpendicular to the crankshaft axis 33 and the horizontal plane 50 facing the cylinder block 3 of the flywheel 9 is preferably shorter than a maximum distance between a plane parallel with a plain portion of the scavenging path cover 28 passing through the cylinder axis 31 and the bolt 30*a*. It is therefore possible to shorten the distance between the cylinder 23 and the flywheel 9 by avoiding the arrangement of parts such as the scavenging path cover 28 on the crankshaft axis 33 between the cylinder 23 and the flywheel 9 It is therefore possible to shorten the dimensions of the engine 2 in the direction of the crankshaft axis 33 and to make a smaller engine 2. Portability and ease of operation can also be improved because it is also possible to make the width (width in a direction perpendicular to the plane formed by the guide bar 5) of the chainsaw 1 compact. As illustrated in FIG. 1 and FIG. 2, the scavenging path cover 28 closer to the flywheel 9 is preferably located further toward (left side in FIG. 1) the direction of rotation of the flywheel 9 within a region to which the air flow created by the flywheel 9 is carried (preferably closer to the cylinder 23 than the axis 33 of the crankshaft 6). In other words, the scavenging path cover 28, which is preferably closer to the flywheel 9, is located at the side that is further in the direction of rotation of the flywheel 9 than the circular center 31, which is preferably at the side of the flywheel 9 that overlaps with the cylinder block 3. At the front side (the front side in the direction of rotation, the right side in the drawings) in the direction of rotation of the flywheel 9 at the cylinder block 3, the scavenging path cover 28 does not block the cooling wind from the fins 11 of the flywheel 9. The cooling wind therefore flows effectively through the cylinder block 3 and the surrounding parts and it is possible to maintain good cooling performance of the cylinder block 3 etc. Furthermore, all of the bolts 30 (30*a*, 30*b*, 30*c*) that fix the scavenging path cover 28 to the side of the flywheel 9 do not interfere with the flywheel 9. The bolts 30 can therefore be easily reached making the engine 2 easier to maintain.

Figure 5:
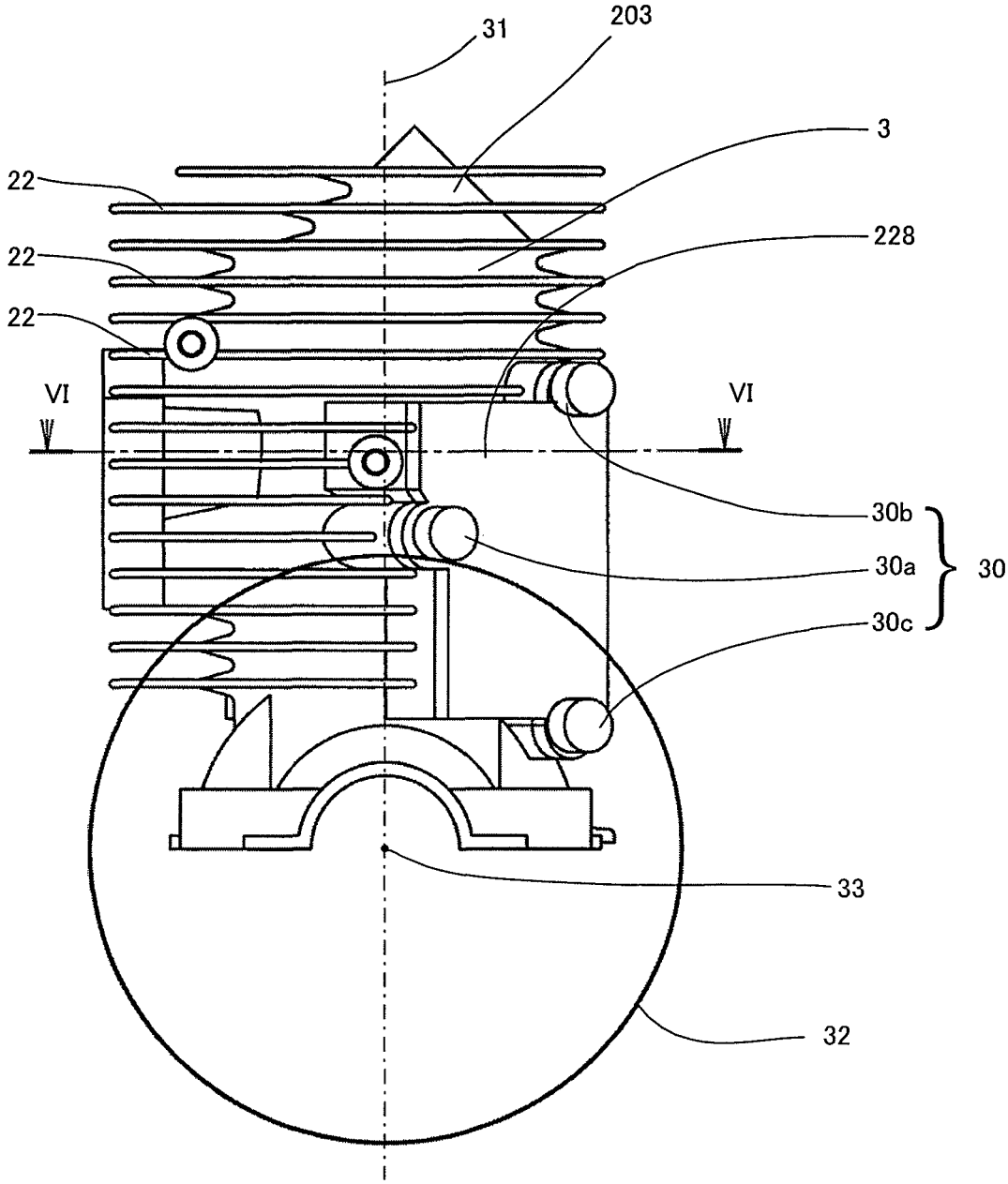
FIG. 5 is a side view illustrating a flywheel side of a cylinder block portion of an engine for a second embodiment of the present invention.
Figure 6:
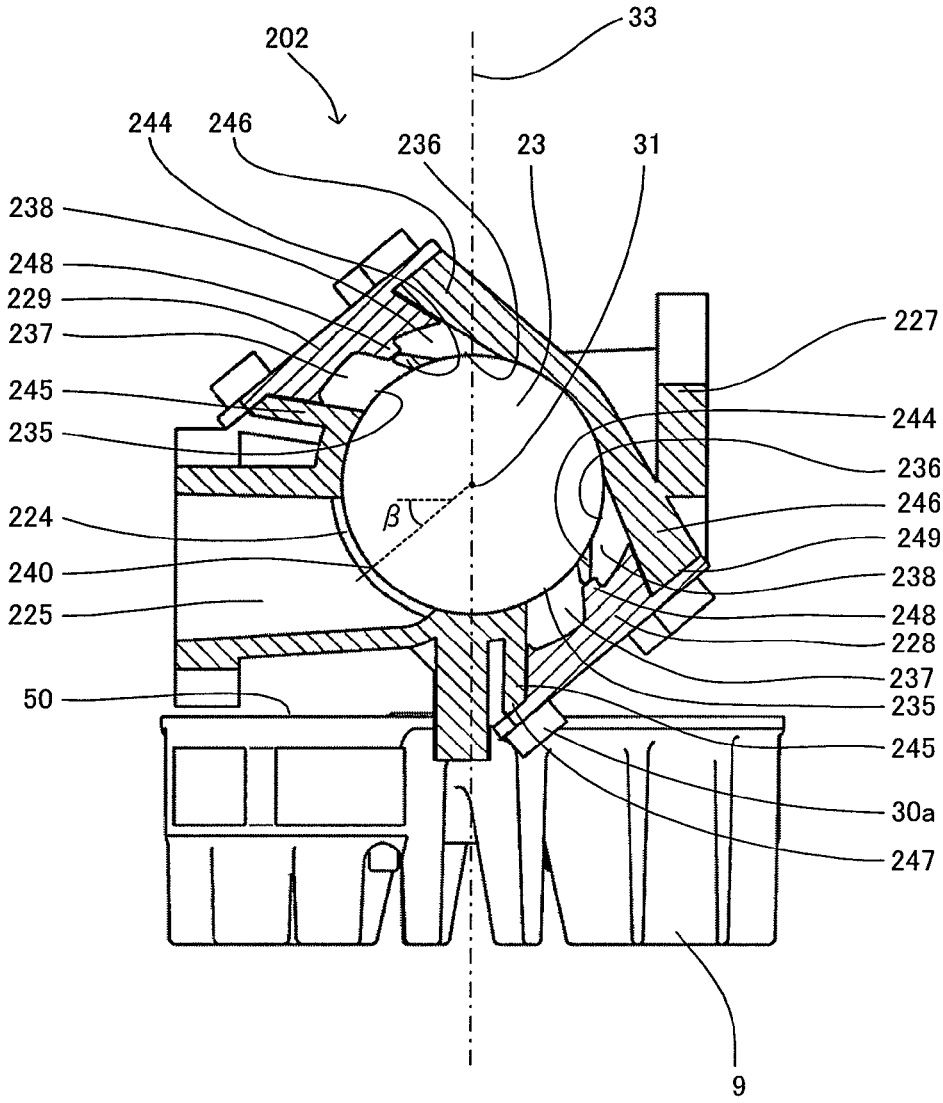
FIG. 6 illustrates a cross-sectional view along VI-VI of FIG. 5.

Next, the following is an explanation of an engine 202 of a second embodiment using FIGS. 5 and 6 At the engine 2, the exhaust port 24, the first and second scavenging ports 35 and 36, and the intake port 26 of the previously disclosed embodiment are rotated by a predetermined angle α in a clockwise direction as viewed in the direction of the cylinder axis 31. With regards to this, at the engine 202, the ports are located rotated by a predetermined angle β in a counterclockwise direction. FIGS. 5 and 6 are views corresponding to FIGS. 3 and 4 respectively, with some portions similar to FIG. 1 thru FIG. 4 having the same numeric labels but not explained.

As illustrated in FIGS. 5 and 6, a center 240 on the circumferential portion of an exhaust port 224 is preferably displaced in a direction closer to the flywheel 9 than the cylinder axis 31 with respect to the direction of the crankshaft axis 33, when viewed in the direction of the cylinder axis 31. The exhaust port 224 is preferably formed in such a manner that a line linking the center 240 on the circumferential portion of the cylinder 23 and the cylinder axis 31 displaced in the circumferential direction forms an angle β of, for example, forty degrees in a counterclockwise direction towards the flywheel 9 from a horizontal plane perpendicular to the crankshaft axis 33.

The intake port (not shown) preferably faces the exhaust port 224 so that the center of the circumferential portion of the intake port is symmetrical to the exhaust port 224 thereby across the cylinder axis 31 from the center 240 on the circumferential portion of the exhaust port 224, when viewed in the direction of the cylinder axis 31. The position with respect to the cylinder axis 31 of the exhaust port 224 is different to the position of the intake port with respect to the cylinder axis 31. An exhaust path 225 and an intake path 227 extend in parallel with each other in a direction perpendicular to the crankshaft axis 33 when viewed in the direction of the cylinder axis 31.

First and second scavenging ports 235 and 236 are interconnected with the crank chamber within the crank case (not shown) via first and second scavenging paths 237 and 238 preferably extend in parallel to the cylinder axis 31. The first and second scavenging paths 237 and 238 preferably comprise grooved paths having bulkheads 244, an exhaust side wall 245, and an intake side wall 246, open in a direction towards the outside, and formed at the cylinder block 3. The substantially planar scavenging path covers 228 and 229 preferably have bulkheads 248 embedded at the opened groove. An edge 247 of the exhaust side wall 245 and an edge 249 of the intake side wall 246 are substantially parallel with the planar portions of the scavenging path covers 228 and 229 and are substantially in the same plane when viewed in the direction of the cylinder axis 31. The edge 247 of the exhaust side wall 245 and the edge 249 of the intake side wall 246 are preferably fitting surfaces for the scavenging path covers 228 and 229 and are inclined with respect to the crankshaft axis 33.

The two first scavenging ports 235 are arranged substantially equidistant to a plane passing through the center 240 on a circumferential portion of the exhaust port 224 and the cylinder axis 31 when viewed in the direction of the cylinder axis 31. Similarly, the two first scavenging ports 236 are arranged substantially equidistant with respect to a plane passing through the center 240 on the circumferential portion of the exhaust port 224 and the cylinder axis 31 when viewed in the direction of the cylinder axis 31. The respective opening directions of the first and second scavenging ports 235 and 236 preferably face towards substantially the opposite side of the exhaust port 224 thereby across the cylinder axis 31. As shown in FIG. 6, the grooved paths of the cylinder block 3 are preferably formed so that the scavenging path cover 228 on the side closer to the flywheel 9 is preferably positioned between the intake path 227 and the crankshaft axis 33. The scavenging path cover 229 on the side furthest from the flywheel 9 is preferably positioned between the exhaust path 225 and the crankshaft axis 33. The scavenging path cover 228 and the bolts 30 fixing the scavenging path cover 228 on the side of the flywheel 9 are all preferably positioned to prevent interference with the flywheel 9. Namely, in FIG. 6, the edge of the scavenging path cover 228 and the bolt 30*a* positioned closest to the flywheel 9 do not interfere with the flywheel 9, since they are located outside of the outer peripheral edge 32 of the flywheel 9, as illustrated in FIG. 5.

When viewed in the direction of the cylinder axis 31, a distance between a horizontal plane passing through the cylinder axis 31 that is perpendicular with the crankshaft axis 33 and the horizontal plane 50 facing the cylinder block 3 of the flywheel 9 is shorter than a maximum distance between a plane parallel to a flat portion of the scavenging path cover 228 or a fitting surface of the scavenging path cover 228, the plane passing through the cylinder axis 31, and a flat portion of the scavenging path cover 228 or the head of the bolt 30*a*.

With the engine 202 in this case, as in the embodiment disclosed earlier, it is possible to shorten the distance between the cylinder 23 and the flywheel 9 because locating of parts such as the scavenging path cover 228 on the crankshaft axis 33 between the cylinder 23 in the flywheel 9 is prevented. It is therefore possible to miniaturize the engine 202 by decreasing the dimensions towards the crankshaft axis 33 of the engine 202. Portability and ease of operation of the chainsaw 1 can also be improved because it is also possible to make the width of the chainsaw 1 more compact. Further, all of the bolts 30 (30*a*, 30*b*, 30*c*) that fix the scavenging path cover 228 to the side of the flywheel 9 do not interfere with the flywheel 9. The bolts 30 can therefore be accessed easily and maintenance of the engine 202 is easier. In addition, the first scavenging path 237 and the second scavenging path 238 preferably define the groove path opened at the outside of the cylinder block 3 and the scavenging path covers 228 and 229. It is therefore possible to easily implement shapes for the first scavenging port 235 and the second scavenging port 236 and internal shapes for the first scavenging path 237 and the second scavenging path 238 optimized for the flow of mixture and exhaust gases of the cylinder 23.

The present invention is by no means limited to the above two embodiments. For example, the number of scavenging ports and scavenging paths is by no means limited to two on one side, and three on one side giving a total of six, or more scavenging ports and scavenging paths can be provided. Further, the exhaust paths and the intake paths cannot just be displaced so as to extend in parallel in an opposite direction but can also extend in parallel coaxially as viewed in the direction of the axis of the cylinder providing that an angle between the exhaust paths and the intake paths is maintained. The engine of the present invention is also by no means limited to being mounted on a chainsaw and can also be mounted on a lawnmower or hedge trimmer etc. It is also possible for the device as a whole to be made small in this case.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A two-stroke engine comprising:

a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, and one pair of scavenging path covers attached to the cylinder block for providing one pair of scavenging paths connecting the scavenging ports and a crank chamber, wherein a scavenging path cover of the one pair of scavenging path covers closest to the flywheel is positioned at side of one of the exhaust port and the intake port from the crankshaft when viewed in the axial direction of the cylinder, and a line linking one pair of scavenging ports among the scavenging ports is inclined with respect to an axis of the crankshaft when viewed in the axial direction of the cylinder.

2. The two-stroke engine according to claim 1, wherein the scavenging ports are arranged substantially equidistantly from a plane passing through the center of the exhaust port and the axis of the cylinder and face toward a wall surface on an opposite side from the exhaust port of the cylinder when viewed in the axial direction of the cylinder.

3. The two-stroke engine according to claim 1, wherein an exhaust path and an intake path extend perpendicularly to the axis of the crankshaft when viewed in the axial direction of the cylinder.

4. The two-stroke engine according to claim 1, wherein the scavenging path cover closer to the flywheel is located at a more posterior position than the axis of the cylinder with respect to a direction of rotation of the flywheel when viewed in the axial direction of the crankshaft.

5. A motorized implement comprising the two-stroke engine according to claim 1.

6. The motorized implement according to claim 5, wherein the motorized implement is a chainsaw, and the two-stroke engine is located in such a manner that the crankshaft is at a right angle with respect to the direction of projection of a guide bar.

7. A two-stroke engine comprising:

a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, and one pair of scavenging path covers attached to the cylinder block for providing one pair of scavenging paths connecting the scavenging ports and a crank chamber, wherein a scavenging path cover of the one pair of scavenging path covers closest to the flywheel is positioned at side of one of the exhaust port and the intake port from the crankshaft when viewed in the axial direction of the cylinder, the intake port is located displaced from a plane perpendicular to the axis of the crankshaft in a direction closer to the flywheel and the exhaust port is located displaced from the plane perpendicular to the axis of the crankshaft in a direction further away from the flywheel when viewed in the axial direction of the cylinder, and the scavenging path cover of the one pair of scavenging path covers closest to the flywheel is positioned between the axis of the crankshaft and an exhaust path connected to the exhaust port.

8. A two-stroke engine comprising:

a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, and one pair of scavenging path covers attached to the cylinder block for providing one pair of scavenging paths connecting the scavenging ports and a crank chamber, wherein a scavenging path cover of the one pair of scavenging path covers closest to the flywheel is positioned at side of one of the exhaust port and the intake port from the crankshaft when viewed in the axial direction of the cylinder, the exhaust port is located displaced from a plane perpendicular to the axis of the crankshaft in a direction closer to the flywheel and the intake port is located displaced from the plane perpendicular to the axis of the crankshaft in a direction further away from the flywheel when viewed in the axial direction of the cylinder, and the scavenging path cover of the one pair of scavenging path covers closest to the flywheel is positioned between the axis of the crankshaft and an intake path connected to the intake port.

9. A two-stroke engine comprising:

a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, and one pair of scavenging path covers attached to the cylinder block for providing one pair of scavenging paths connecting the scavenging ports and a crank chamber, wherein a scavenging path cover of the one pair of scavenging path covers closest to the flywheel is positioned at side of one of the exhaust port and the intake port from the crankshaft when viewed in the axial direction of the cylinder, the one pair of scavenging path covers are fitted to the cylinder block using a plurality of fitting members, and a fitting member of the plurality of fitting members positioned closest to the flywheel when viewed in the axial direction of the cylinder is positioned on the outside of the outer periphery of the flywheel when viewed in the axial direction of the crankshaft.

10. A two-stroke engine, comprising:

a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, one pair of scavenging path covers fitted to the cylinder block using fastening members for providing one pair of scavenging paths connecting the scavenging ports and a crank chamber; and wherein, when viewed in the axial direction of the cylinder, a fitting surface for the cylinder block and the scavenging path cover is provided inclined with respect to an axis of the crankshaft, and a distance between a horizontal plane passing through the axis of the cylinder perpendicular to the axis of the crankshaft and a horizontal plane facing the cylinder block of the flywheel is shorter than a maximum distance between a plane passing through the axis of the cylinder parallel with the fitting surface and the scavenging path cover or a fastening member closest to the flywheel.

11. A motorized implement comprising the two-stroke engine according to claim 10.

12. The motorized implement according to claim 11, wherein the motorized implement is a chainsaw, and the two-stroke engine is located in such a manner that the crankshaft is at a right angle with respect to the direction of projection of a guide bar.

13. A two-stroke engine comprising:

a cylinder block, an exhaust port formed at an inner wall of the cylinder block, an intake port formed at the inner wall opposite to the exhaust port, a crankshaft being rotatable, a flywheel provided on the crankshaft, at least one pair of scavenging ports formed at the inner wall and between the exhaust port and the intake port, one pair of scavenging path covers fitted to the cylinder block using fastening members for providing one pair of scavenging paths connecting the scavenging ports and a crank chamber; and wherein a portion of the scavenging path cover or the fastening member close to the flywheel, when viewed in the axial direction of the cylinder, that is furthest away from a horizontal plane passing through an axis of the cylinder perpendicular to an axis of the crankshaft is positioned to a side further from the cylinder block than a horizontal surface facing the cylinder block of the flywheel, and when viewed in an axial direction of the crankshaft, the portion of the scavenging path cover or the fastening member close to the flywheel, that is furthest away from the horizontal plane passing through the axis of the cylinder perpendicular to the axis of the crankshaft is positioned outside of the outer periphery of the flywheel.

14. A motorized implement comprising the two-stroke engine according to claim 13.

15. The motorized implement according to claim 14, wherein the motorized implement is a chainsaw, and the two-stroke engine is located in such a manner that the crankshaft is at a right angle with respect to the direction of projection of a guide bar.

* * * * *